US010247188B2

(12) United States Patent
Masuda et al.

(10) Patent No.: US 10,247,188 B2
(45) Date of Patent: Apr. 2, 2019

(54) SCROLL COMPRESSOR

(71) Applicant: Hitachi-Johnson Controls Air Conditioning, Inc., Tokyo (JP)

(72) Inventors: Naoki Masuda, Tokyo (JP); Tomohito Akiyama, Tokyo (JP); Shuhei Niimura, Tokyo (JP); Taiga Fuchino, Tokyo (JP); Tetsuya Tadokoro, Tokyo (JP); Masatsugu Chikano, Tokyo (JP)

(73) Assignee: Hitachi-Johnson Controls Air Conditioning, Inc., Tokyo (JP)

( * ) Notice: Subject to any disclaimer, the term of this patent is extended or adjusted under 35 U.S.C. 154(b) by 0 days.

(21) Appl. No.: 15/769,399

(22) PCT Filed: Aug. 23, 2017

(86) PCT No.: PCT/JP2017/030206
§ 371 (c)(1),
(2) Date: Apr. 19, 2018

(87) PCT Pub. No.: WO2018/051750
PCT Pub. Date: Mar. 22, 2018

(65) Prior Publication Data

US 2018/0306186 A1 Oct. 25, 2018

(30) Foreign Application Priority Data

Sep. 14, 2016 (JP) ..... 2016-179937

(51) Int. Cl.
*F04C 18/02* (2006.01)
*F04C 29/02* (2006.01)

(52) U.S. Cl.
CPC ..... *F04C 18/0215* (2013.01); *F04C 18/02* (2013.01); *F04C 18/0261* (2013.01);
(Continued)

(58) Field of Classification Search
CPC ..... F04C 18/0215; F04C 18/0261; F04C 29/028; F04C 2240/30; F04C 2240/40
See application file for complete search history.

(56) References Cited

U.S. PATENT DOCUMENTS 4,303,379 A * 12/1981 Hiraga ..... F04C 18/0246 418/55.2
4,332,535 A * 6/1982 Terauchi ..... F04C 18/0215 418/55.6

(Continued)

FOREIGN PATENT DOCUMENTS

CN 105332911 A 2/2016
CN 105587662 A 5/2016

(Continued)

OTHER PUBLICATIONS

International Search Report and Written Opinion of PCT/JP2017/030206 dated Nov. 21, 2017.

*Primary Examiner* — Mark A Laurenzi
*Assistant Examiner* — Shafiq Mian
(74) *Attorney, Agent, or Firm* — Mattingly & Malur, PC

(57) ABSTRACT

A scroll compressor includes a fixed scroll, an orbiting scroll, a suction section, a discharge section, and an electric motor. A sliding surface of a scroll is formed outside a wrap with a depression section depressed with respect to a sliding surface and a flange section elevated with respect to the depression section. The flange section is a remaining region in a protruding region disposed outside a referential perfect circle, the remaining region being other than a region continuing to an end of an involute curve of a scroll formed with the flange section, the referential perfect circle having a radius set to a distance between the center of the scroll formed with the flange section and the end of the involute curve. The scroll compressor enhances reduction of the sliding loss with a simple structure and reduction of the refrigerant leakage loss in the entire compression chambers.

7 Claims, 11 Drawing Sheets

(52) U.S. Cl.
CPC ..... *F04C 29/028* (2013.01); *F04C 2240/30* (2013.01); *F04C 2240/40* (2013.01)

(56) References Cited

U.S. PATENT DOCUMENTS

| | | | | |
|---|---|---|---|---|
| 5,342,184 | A * | 8/1994 | Comparin | F01C 1/0246 29/888.022 |
| 10,066,625 | B2 * | 9/2018 | Cho | F04C 29/02 |
| 2005/0201883 | A1 * | 9/2005 | Clendenin | F01C 1/0215 418/55.5 |
| 2006/0171831 | A1 | 8/2006 | Elson et al. | |
| 2008/0232990 | A1 * | 9/2008 | Reinhart | F04C 18/0215 418/55.3 |
| 2009/0068044 | A1 * | 3/2009 | Guo | F01C 21/10 418/55.1 |
| 2012/0177523 | A1 * | 7/2012 | Won | F01C 17/066 418/55.5 |
| 2017/0045049 | A1 * | 2/2017 | Park | F04C 18/0215 |

FOREIGN PATENT DOCUMENTS

| | | | |
|---|---|---|---|
| JP | 02-022687 | A | 2/1990 |
| JP | 9-126161 | A | 5/1997 |
| JP | 2006-152930 | A | 6/2006 |
| JP | 2015-169081 | A | 9/2015 |

* cited by examiner

SCROLL COMPRESSOR

TECHNICAL FIELD

The present invention relates to a scroll compressor.

BACKGROUND ART

Compressors to compress working fluid such as a refrigerant are used in various apparatuses. Refrigeration cycle apparatuses such as refrigerating machines, water heaters, and air conditioners employ scroll compressors as a device to compress refrigerant gas.

A scroll compressor includes: a fixed scroll including a spiral wrap stood on an end plate (a base plate); and an orbiting scroll including a spiral wrap stood on an end plate (a sliding plate). The scroll compressor has a structure in which the fixed scroll and the orbiting scroll are arranged to face each other so that the wraps thereof engage with each other. In the scroll compressor, the orbiting scroll orbits to sequentially reduce the volumes of a plurality of compression chambers formed between the wraps, thereby compressing the refrigerant.

Such compression operation produces axial force (hereinafter, referred to as "separating force") which attempts to separate the fixed scroll and the orbiting scroll from each other. In addition to the axial force (separating force), tangential force, radial force, and centrifugal force are applied to the orbiting scroll by the compression operation. These forces produce a moment (an upsetting moment) that attempts to tilt the orbiting scroll. The orbiting scroll thereby swings. If the scrolls are separated from each other, a gap is formed between the end (the end surface) of the wrap and the bottom thereof. Accordingly, the sealing performance of the compression chambers cannot be maintained, and the refrigerant leaks in the compression chambers (especially in the vicinity of the suction chamber where the seal length is short). The efficiency of the compressor is thereby reduced.

In view of this, a backpressure chamber is formed, on the back of the sliding plate of the orbiting scroll, to hold backpressure to press the orbiting scroll against the fixed scroll. The backpressure is pressure within the backpressure chamber and takes an intermediate value between the discharge pressure and the suction pressure. In the scroll compressor having this structure, the orbiting scroll is pressed against the fixed scroll with the backpressure within the backpressure chamber to cancel out the separating force and produce a force (hereinafter, referred to as pressing force) to press a sliding surface of the orbiting scroll against a sliding surface of the fixed scroll. In the scroll compressor having this structure, the refrigerant leakage loss can be reduced in the compression chambers (especially in the vicinity of the suction chamber where the seal length is short) by the pressing force. Herein, the sliding surface of the fixed scroll is a surface formed so as to continue to the end surface of the wrap of the fixed scroll. The sliding surface of the orbiting scroll is a surface of the outer peripheral portion of the sliding plate of the orbiting scroll which comes into contact with the fixed scroll.

However, the pressing force produces sliding friction between the sliding surface of the fixed scroll and the sliding surface of the orbiting scroll. When the pressing force excessively increases, the sliding loss increases, and the performance of the compressor decreases.

Accordingly, a scroll compressor is proposed which includes a backpressure introduced space on the sliding surface of the fixed scroll or the orbiting scroll. To the backpressure introduced space, the pressure (backpressure) within the backpressure chamber is introduced. This increases the pressing force in a region where a lot of refrigerant leaks between the sliding surfaces to reduce the refrigerant leakage loss in the compression chambers (Patent Document 1, for example). In the scroll compressor having this structure, the refrigerant leakage loss in the compression chamber (especially in the vicinity of the suction chamber where the seal length is short) and the sliding loss can be reduced.

CITATION LIST

Patent Literature

Patent Literature 1: Japanese Patent Laid-open Publication No. 2006-152930

SUMMARY OF INVENTION

Technical Problem

However, the conventional scroll compressor described in Patent Literature 1 has a problem that the area of contact between the sliding surface of the fixed scroll and the sliding surface of the orbiting scroll is large, and the sliding loss is still large, as described below.

For example, an object of the conventional scroll compressor described in Patent Literature 1 is to reduce the refrigerant leakage loss between the sliding surface of the fixed scroll and the sliding surface of the orbiting scroll. In the conventional scroll compressor, therefore, the seal length to reduce refrigerant leakage is excessively elongated. The area of contact between the sliding surface of the fixed scroll and the sliding surface of the orbiting scroll is therefore increased, and the sliding loss in the conventional scroll compressor therefore remains large. Such a conventional scroll compressor still has room for improvement.

In addition, as described later, the conventional scroll compressor has a problem that when the backpressure introduced space is expanded, the orbiting scroll is more likely to swing. This can increase the amount of refrigerant leakage in the entire compression chambers.

If the backpressure introduced space is simply expanded in the conventional scroll compressor for the purpose of reducing the area of contact between the sliding surfaces, the force pressing down a portion of the sliding surface of the orbiting scroll that corresponds to the backpressure introduced space increases. Specifically, another force pressing the portion of the sliding surface of the orbiting scroll that corresponds to the backpressure introduced space is produced in addition to the upsetting moment. In the conventional scroll compressor, the orbiting scroll is thus more likely to swing. This can increase the amount of refrigerant leakage in the entire compression chambers.

The present invention has been made to solve the aforementioned problem. A major object of the present invention is to provide a highly-efficient scroll compressor which reduction of the sliding loss is enhanced with a simple structure and reduction of the refrigerant leakage loss in the entire compression chambers is enhanced.

Solution to Problem

To solve the above problems, the present invention is a scroll compressor including: a fixed scroll including an end plate and a spiral wrap standing on the end plate: an orbiting scroll which includes an end plate and a spiral wrap standing on the end plate and forms a compression chamber between the fixed scroll and the orbiting scroll, the compression chamber having a refrigerant to be compressed therein; a suction section configured to introduce the refrigerant from an outside to an inside of the compressor; a discharge section configured to discharge the refrigerant from the inside to the outside of the compressor; and an electric motor configured to orbit the orbiting scroll. At least one scroll of the fixed scroll and the orbiting scroll includes a sliding surface which is formed outside a wrap with a depression section depressed with respect to the sliding surface and a flange section elevated with respect to the depression section. The flange section is a remaining region in a protruding region disposed outside a referential perfect circle, the remaining region being other than the region continuing to an end of an involute curve of a scroll formed with the flange section, the referential perfect circle having a radius set to a distance between the center of the scroll formed with the flange section and the end of the involute curve.

Advantageous Effects of Invention

According to the present invention, it is possible to enhance reducing the sliding loss with a simple structure and enhance reducing the refrigerant leakage loss in the entire compression chamber.

The other means are described later.

DESCRIPTION OF EMBODIMENTS

Figure 1:
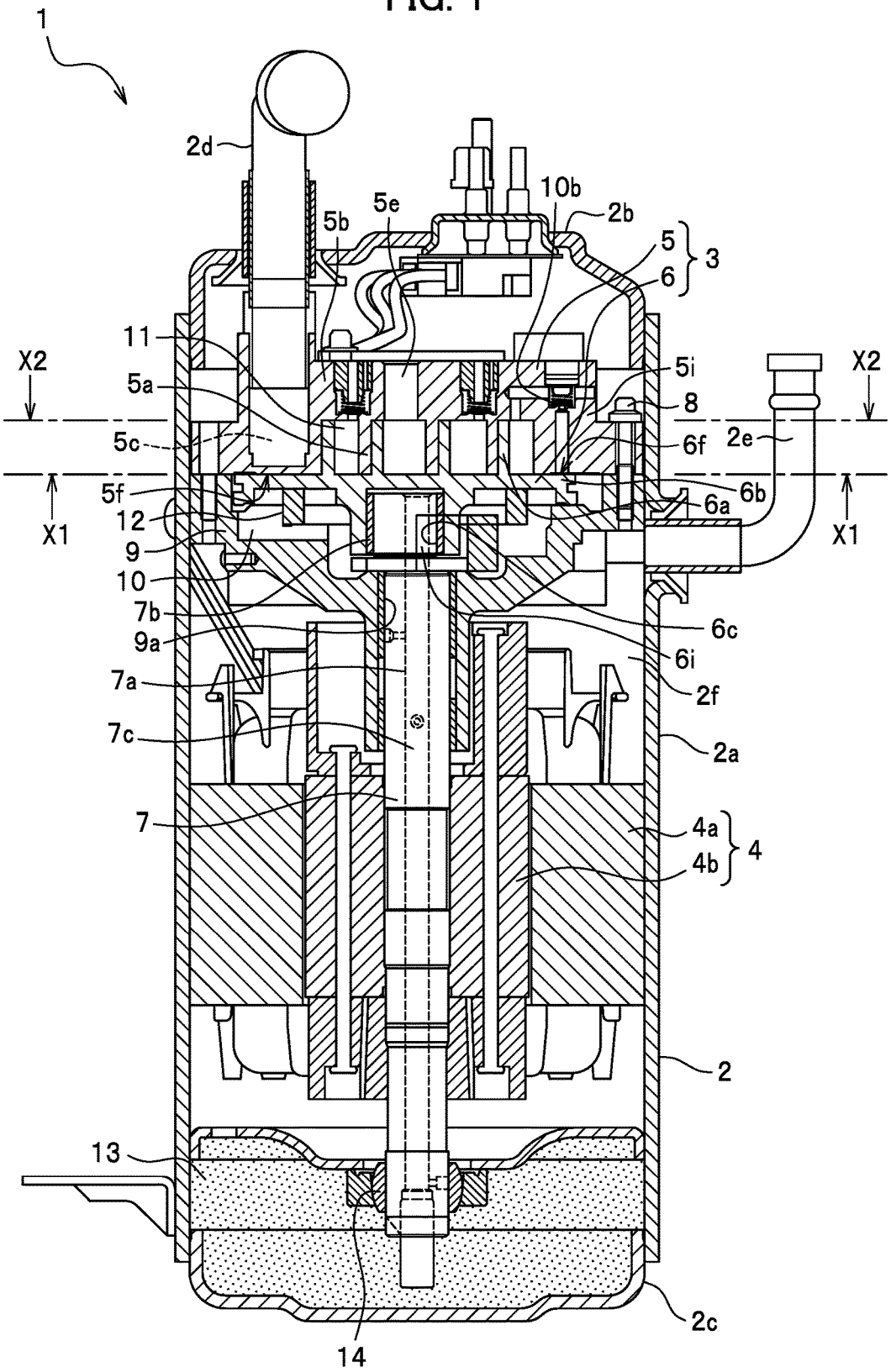
FIG. 1 is a longitudinal sectional view of a scroll compressor according to Embodiment 1.

Hereinafter, embodiments of the present invention (hereinafter, referred to as embodiments) will be described with reference to the accompanying drawings. Each drawing is just shown schematically to some extent enough to allow sufficient understanding of the present invention. The present invention is not limited to the examples illustrated in the drawings. In each drawing, the same or similar constituent components are given the same reference numerals, and the redundant description thereof is omitted.

Embodiment 1

Embodiment 1 provides a scroll compressor 1 (see FIG. 5), in which later-described depression sections 5*g* and a later-described flange section 5*h* are provided in a sliding surface 5*f* of a later-described fixed scroll 5, or a scroll compressor 1 (see FIG. 9), in which later-described depression sections 6*g* and a later-described flange section 6*h* are provided in a sliding surface 6*f* of a later-described orbiting scroll 6.

<Construction of Scroll Compressor>

Figure 2:
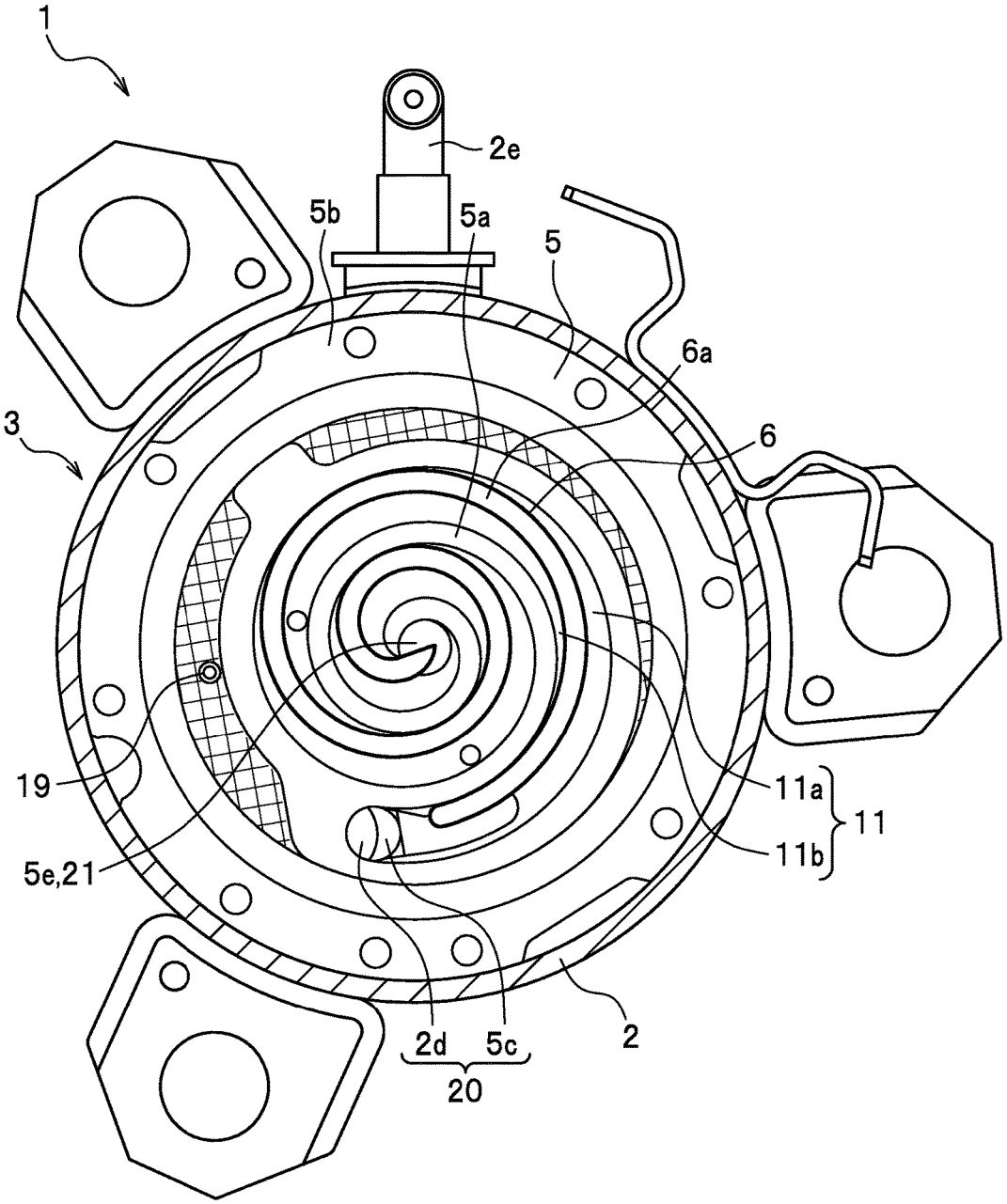
FIG. 2 is a cross-sectional view of the scroll compressor according to Embodiment 1.

Hereinafter, the construction of the scroll compressor 1 according to Embodiment 1 will be described with reference to FIGS. 1 and 2. FIG. 1 is a longitudinal sectional view of the scroll compressor 1. FIG. 2 is a cross-sectional view of the scroll compressor 1. FIG. 2 illustrates the construction of the cross section along a line X1-X1 illustrated in FIG. 1, when viewed from below. The line X1-X1 is included in the sliding surface 5*f* of the later-described fixed scroll 5 and the sliding surface 6*f* of the later-described orbiting scroll 6.

As illustrated in FIG. 1, the scroll compressor 1 includes a compression mechanism 3, an electric motor 4, and a sealed casing 2. The compression mechanism 3 includes the orbiting scroll 6 with a spiral wrap 6*a* stood thereon and the fixed scroll 5 with a spiral wrap 5*a* stood thereon. The electric motor 4 drives the compression mechanism 3. The sealed casing 2 accommodates the compression mechanism 3 and the electric motor 4. The orbiting scroll 6 is a moving member that moves to form compression chambers that compress a refrigerant, between the orbiting scroll 6 and the fixed scroll 5. The fixed scroll 5 is a fixed member which is fixed within the scroll compressor 1. The compression mechanism 3 is disposed in upper part of the sealed casing 2. The electric motor 4, which orbits (moves) the orbiting scroll 6, is disposed in lower part of the sealed casing 2. In the bottom of the sealed casing 2, lubricant 13 is reserved.

The sealed casing 2 includes a cylindrical cylinder chamber 2*a*, a top chamber 2*b*, and a bottom chamber 2*c* and has a sealed structure. The sealed casing 2 is formed by welding the top chamber 2*b* to the top of the cylinder chamber 2*a* and welding the bottom chamber 2*c* to the underside of the cylinder chamber 2*a*. To the top chamber 2*b*, a suction pipe 2*d* is attached. In Embodiment 1, the suction pipe 2*d* is attached to the upper surface of the top chamber 2*b* and is positioned so as to extend in the longitudinal direction (that is, positioned lengthwise). To the side surface of the cylinder chamber 2*a*, a discharge pipe 2*e* is attached. In the vicinity of the suction pipe 2*d* within the sealed casing 2, a suction chamber 5*c* is provided. The suction chamber 5*c* is a space to which the refrigerant is sucked. The suction chamber 5*c* serves as a compression chamber 11 after trapping of the refrigerant is completed by the orbital motion of the orbiting scroll 6. Within the sealed casing 2, a discharge pressure space 2*f* is provided. A discharge port 5*e* is provided on a center O (see FIG. 6) of a base plate 5*b* of the fixed scroll 5, which corresponds to an axis of the fixed scroll 5, so as to communicate with the compression chamber 11 in the innermost side.

The compression mechanism 3 includes: the fixed scroll 5 including the spiral wrap 5*a* on the end plate (base plate) 5*b*; the orbiting scroll 6 including the spiral wrap 6*a* on the end plate (sliding plate) 6*b*; and a frame 9, which is fastened to the fixed scroll 5 with bolts 8 and supports the orbiting scroll 6.

The fixed scroll 5 includes: the end plate (base plate) 5*b*, which has a circular disk shape; the wrap 5*a*, which is stood on the base plate 5*b* in a spiral manner; and a cylindrical support section 5*i*, which is located on the periphery of the base plate 5*b* and surrounds the wrap 5*a*. A bottom surface 5*d* (see FIG. 5) of the base plate 5*b* is at the bottom of the wrap 5*a*, which serves as a tooth configured to engage with the wrap 6*a* of the orbiting scroll 6, and is referred to as a tooth bottom. In the support section 5*i* as the outer periphery of the base plate 5*b*, a surface continuing to the end surface of the wrap 5*a* constitutes a sliding surface 5*f* of the fixed scroll 5. The sliding surface 5*f* of the fixed scroll 5 is the surface configured to come into contact with the later-described sliding surface 6*f* of the orbiting scroll 6.

The fixed scroll 5 is fixed to the frame 9 at the support section 5*i* with the bolts 8 and the like. The frame 9, which is integrated with the fixed scroll 5, is fixed to the inside of the cylinder chamber 2*a* of the sealed casing 2 by fixing means such as welding.

On the other hand, the orbiting scroll 6 is disposed within the frame 9 so as to orbit, facing the fixed scroll 5. The orbiting scroll 6 includes: the end plate (the sliding plate) 6*b*, which has a circular disk shape; the spiral wrap 6*a*, which is stood on the base plate 6*b* in the spiral manner; and a boss section 6*i*, which is provided at the center of the back surface of the sliding plate 6*b*. The bottom surface 6*d* (see FIG. 9) of the sliding plate 6*b* is at the bottom of the wrap 6*a*, which serves as a tooth configured to engage with the wrap 5*a* of the fixed scroll 5, and is referred to as a tooth bottom. The surface of the outer periphery of the sliding plate 6*b* that comes into contact with the end surface of the wrap 5*a* of the fixed scroll 5 serves as the sliding surface 6*f* of the orbiting scroll 6. The axis of the orbiting scroll 6 is shifted by a predetermined distance δ (not illustrated) from the axis of the fixed scroll 5. The wrap 6*a* of the orbiting scroll 6 is laid on the wrap 5*a* of the fixed scroll 5 with a predetermined angle in the circumferential direction.

On the back of the sliding plate 6*b* of the orbiting scroll 6, a backpressure chamber 10 is formed. The backpressure chamber 10 holds backpressure to press the orbiting scroll 6 against the fixed scroll 5. The backpressure chamber 10 is formed by the fixed scroll 5, the orbiting scroll 6, a crankshaft 7, and the frame 9. The backpressure chamber 10 is connected to the compression chambers 11 through a communication channel. In the middle of the communication channel, a backpressure regulation valve 10*a* is provided.

The frame 9 includes a main bearing 9*a*, which rotatably supports the crankshaft 7. The lower surface side of the orbiting scroll 6 is connected to an eccentric section 7*b* of the crankshaft 7. The crankshaft 7 is rotatably disposed within the frame 9 and is coaxial with the fixed scroll 5.

Between the lower surface of the orbiting scroll 6 and the frame 9, an Oldham ring 12 is provided. The Oldham ring 12 is a mechanism to restrict the orbiting scroll 6 so that the orbiting scroll 6 does not rotate with respect to the fixed scroll 5 while allowing the orbiting scroll 6 to orbit relatively. The Oldham ring 12 is attached to a groove formed in the lower surface of the orbiting scroll 6 and a groove formed in the upper surface of the frame 9. The Oldham ring 12 allows the orbiting scroll 6 to orbit, without rotating, upon eccentric rotation of the eccentric section 7*b* of the crankshaft 7.

The electric motor 4 includes a stator 4*a* and a rotator 4*b*. The stator 4*a* is fixed within the sealed casing 2 by pressure insertion, welding, or the like. The rotator 4*b* is rotatably disposed within the stator 4*a*. The rotator 4*b* is fixed to the crankshaft 7.

The crankshaft 7 includes a main shaft 7*a* and the eccentric section 7*b*. The crankshaft 7 is supported by the main bearing 9*a*, which is provided for the frame 9, and a lower bearing 14, which is provided near the bottom of the cylinder chamber 2*a*. The eccentric section 7*b* is eccentrically integrated with the main shaft 7*a*. The eccentric section 7*b* is fit in an orbiting bearing 6*c*, which is provided for the boss section 6*i* in the back of the orbiting scroll 6. The crankshaft 7 is driven by the electric motor 4. In this process, the eccentric section 7*b* of the crankshaft 7 eccentrically rotates with respect to the main shaft 7*a* to allow the orbiting scroll 6 to orbit. Within the crankshaft 7, a lubrication channel 7*c* is provided which introduces the lubricant 13 to the orbiting bearing 6*c*, main bearing 9*a*, and lower bearing 14.

As illustrated in FIG. 2, the suction pipe 2*d* and suction chamber 5*c* are provided in slightly outer positions of the base plate 5*b* of the fixed scroll 5. The suction pipe 2*d* and suction chamber 5*c* constitute a suction section 20 that introduces the refrigerant from the outside of the scroll compressor 1. In the substantially center of the base plate 5*b* of the fixed scroll 5, the discharge port 5*e* is provided. In the outer periphery of the fixed scroll 5, a lubrication hole 19 to supply the lubricant 13 is provided.

The orbiting scroll 6 is disposed so as to orbit, facing the fixed scroll 5. The compression mechanism 3 causes the orbiting scroll 6 to orbit with the wrap 6*a* of the orbiting scroll 6 and the wrap 5*a* of the fixed scroll 5 engaged with each other, thus forming a plurality of crescent compression chambers 11 between the wrap 5*a* of the fixed scroll 5 and the wrap 6*a* of the orbiting scroll 6. The plurality of compression chambers 11 communicate with the suction chamber 5*c*. In Embodiment 1, the plurality of compression chambers 11 include two compression chambers 11 formed on the outer curve and inner curve of the wrap 6*a* of the orbiting scroll 6. Hereinafter, the compression chamber 11 formed on the outer curve of the wrap 6*a* of the orbiting scroll 6 is referred to as an outside compression chamber 11*a*. The compression chamber 11 formed on the inner curve of the wrap 6*a* of the orbiting scroll 6 is referred to as an inside compression chamber 11*b*. The outside and inside compression chambers 11*a* and 11*b* move toward the discharge port 5*e* with the orbital motion of the orbiting scroll 6 and continuously decrease in volume with the movement.

When the orbiting scroll 6 orbits with the crankshaft 7 driven by the electric motor 4, the refrigerant is introduced to the compression chambers 11 from the suction pipe 2*d* through the suction chamber 5*c*. The compression chambers 11 decreases in volume as the orbiting scroll 6 orbits. The refrigerant is thereby compressed. The compressed refrigerant is discharged from the discharge port 5*e* to the discharge pressure space 2*f* within the sealed casing 2 (see FIG. 1) and is then discharged out of the scroll compressor 1 through the discharge pipe 2*e* (see FIG. 1). The discharge port 5*e*, discharge pressure space 2*f*, and discharge pipe 2*e* constitute a discharge section 21. A clearance is formed across the substantially entire circumference between the outer circumferential surface of the fixed scroll 5 and the inner wall surface of the cylinder chamber 2*a* of the sealed casing 2 and between the outer circumferential surface of the frame 9 and the inner wall surface of the cylinder chamber 2*a* of the sealed casing 2. The discharge pressure space 2*f* is formed between above the discharge port 5*e* and the vicinity of the bottom of the sealed casing 2 through the clearance.

Herein, the operation of the scroll compressor 1 will be described with reference to mainly FIG. 1.

First, the scroll compressor 1 drives and rotates the crankshaft 7 with the electric motor 4. The rotational driving force is transmitted from the eccentric section 7*b* of the crankshaft 7 through the orbiting bearing 6*c* to the orbiting scroll 6. The orbiting scroll 6 performs orbital motion around the axis (the center O (see FIG. 6)) of the fixed scroll 5 with an orbiting radius of the predetermined distance δ (not illustrated). In this process, the Oldham ring 12 restricts the orbiting scroll 6 so that the orbiting scroll 6 does not rotate while allowing the orbiting scroll 6 to orbit relatively.

With the orbital motion of the orbiting scroll 6, the compression chambers 11*a* and 11*b* (see FIG. 2), which are formed between the wrap 5*a* of the fixed scroll 5 and the wrap 6*a* of the orbiting scroll 6, move toward the discharge port 5*e*. With the movement, the compression chambers 11*a* and 11*b* continuously decrease in volume. The scroll compressor 1 thereby sequentially compresses the refrigerant sucked from the suction pipe 2*d* within the compression chambers 11*a* and 11*b* (see FIG. 2) and discharges the compressed refrigerant through the discharge port 5*e* to the discharge pressure space 2*f*. The discharged refrigerant fills the inside of the sealed casing 2 to be supplied through the discharge pipe 2*e* to a refrigeration cycle, for example, outside the sealed casing 2.

In the aforementioned construction, the lubricant 13 is reserved in the bottom of the sealed casing 2. The inside of the sealed casing 2 serves as the discharge pressure space 2*f*. The pressure (discharge pressure) inside the discharge pressure space 2*f* is higher than the pressure (backpressure) within the backpressure chamber 10. The lubricant 13 reserved in the bottom of the sealed casing 2 flows into the backpressure chamber 10 through the lubrication channel 7*c*, which is provided in the crankshaft 7, due to the difference between the discharge pressure within the sealed casing 2 and the backpressure within the backpressure chamber 10. Specifically, the lubricant 13 flows through the lubrication channel 7*c*, which is provided in the crankshaft 7, and reaches the eccentric section 7*b* of the crankshaft 7. The lubricant 13 then passes through the orbiting bearing 6*c*, which is provided in the boss section 6*i* of the orbiting scroll 6, and the main bearing 9*a*, which is provided in the frame 9, into the backpressure chamber 10. In this process, the lubricant 13 lubricates the orbiting bearing 6*c* and main bearing 9*a*.

The lubricant 13 flows into the backpressure chamber 10 through the orbiting bearing 6*c* and main bearing 9*a* with a pressure lower than the discharge pressure since the spaces in the orbiting bearing 6*c* and main bearing 9*a* are small. When the backpressure of the backpressure chamber 10 is higher than a specified value, the lubricant 13 having flown into the backpressure chamber 10 opens the backpressure regulation valve 10*a*, which is provided in the middle of the communication channel connecting the backpressure chamber 10 and compression chambers 11 and flows into the compression chambers 11 to be mixed with the refrigerant. The lubricant 13 having flown into the compression chambers 11 passes through the compression chambers 11 with the refrigerant to be discharged through the discharge port 5*e* to the discharge pressure space 2*f*. A part of the lubricant 13 is discharged through the discharge pipe 2*e* to the refrigeration cycle while the other part is separated from the refrigerant within the sealed casing 2 to return to the bottom of the sealed casing 2.

<Structure to Enhance Reducing Refrigerant Leakage Loss in Compression Chamber and Reducing Sliding Loss>

Herein, the structure to enhance reducing the refrigerant leakage loss in the compression chambers 11 and enhance reducing the sliding loss in the scroll compressor 1 will be described.

In the scroll compressor 1, the operation of the compression mechanism 3 to compress the refrigerant produces axial force (separating force) to separate the fixed scroll 5 from the orbiting scroll 6. Separation of the fixed and orbiting scrolls 5 and 6 forms gaps between the end surface of the wrap 5*a* and the tooth bottom 5*d* (see FIG. 5) and between the end surface of the wrap 6*a* and the tooth bottom 6*d* (see FIG. 9). The sealing performance of the compression chambers 11 is not maintained. The refrigerant leaks in the compression chambers 11 (especially in the vicinity of the suction chamber 5*c* where the seal length is short), thus reducing the efficiency of the scroll compressor 1.

On the back of the sliding plate 6*b* of the orbiting scroll 6, the backpressure chamber 10 is formed to hold the backpressure that presses the orbiting scroll 6 against the fixed scroll 5. The backpressure is the pressure within the backpressure chamber 10, and takes an intermediate value between the pressure (discharge pressure) within the discharge pressure space 2*f* and the pressure (suction pressure) within the suction chamber 5*c*. In the thus-configured scroll compressor 1, the backpressure of the backpressure chamber 10 presses the orbiting scroll 6 against the fixed scroll 5 to cancel out the separating force and produce a pressing force that presses the sliding surface 6*f* of the orbiting scroll 6 against the sliding surface 5*f* of the fixed scroll 5. By the pressing force, the refrigerant leakage loss in the compression chambers 11 (especially in the vicinity of the suction chamber 5*c* where the seal length is short) is reduced in the scroll compressor 1.

The sliding surfaces 5*f* and 6*f* face each other with a minute space interposed therebetween. This space plays a role of separating the backpressure chamber 10 and suction chamber 5*c* or compression chambers 11. In the fixed scroll 5, this space is filled with the lubricant 13 supplied from the lubrication hole 19 and the lubricant 13 flown into the compression chambers 11, thus securing the sealing performance between the sliding surfaces 5*f* and 6*f* and reducing the sliding friction between the sliding surfaces 5*f* and 6*f*. The sliding loss is thereby reduced. The smaller the space between the sliding surfaces 5*f* and 6*f*, the less the refrigerant leakage at the sliding surfaces 5*f* and 6*f*. The magnitude of the space between the sliding surfaces 5*f* and 6*f* varies depending on the phase of the orbital motion of the orbiting scroll 6 and the seal length. The amount of refrigerant leakage in the compression chambers 11 therefore varies. The reason therefor will be described later.

When the orbiting scroll 6 orbits, for example, the operation of the compression mechanism 3 to compress the refrigerant produces the axial force (separating force) to separate the fixed scroll and orbiting scroll from each other. By this compression operation, tangential force, radial force, and centrifugal force are applied to the orbiting scroll 6 in addition to the axial force (separating force). These forces produce a moment (upsetting moment) to tilt the orbiting scroll 6, causing the orbiting scroll 6 to swing. The sliding surfaces 5*f* and 6*f* of the fixed scroll 5 and the orbiting scroll 6 are not always parallel while the orbiting scroll 6 orbits. Accordingly, the magnitude of the space between the sliding surfaces 5*f* and 6*f* changes with the phase of the orbital motion of the orbiting scroll 6. With such a change in the magnitude of the space, the refrigerant leakage in the compression chambers 11 changes.

The refrigerant leakage in the compression chambers 11 is affected by the seal length. Herein, the seal length refers to a length of the sliding surfaces 5*f* and 6*f* of the fixed scroll 5 and orbiting scroll 6 in the radial direction and is a length by which the backpressure chamber 10 is separated from the compression chambers 11 or suction chamber 5*c*.

Figure 3:
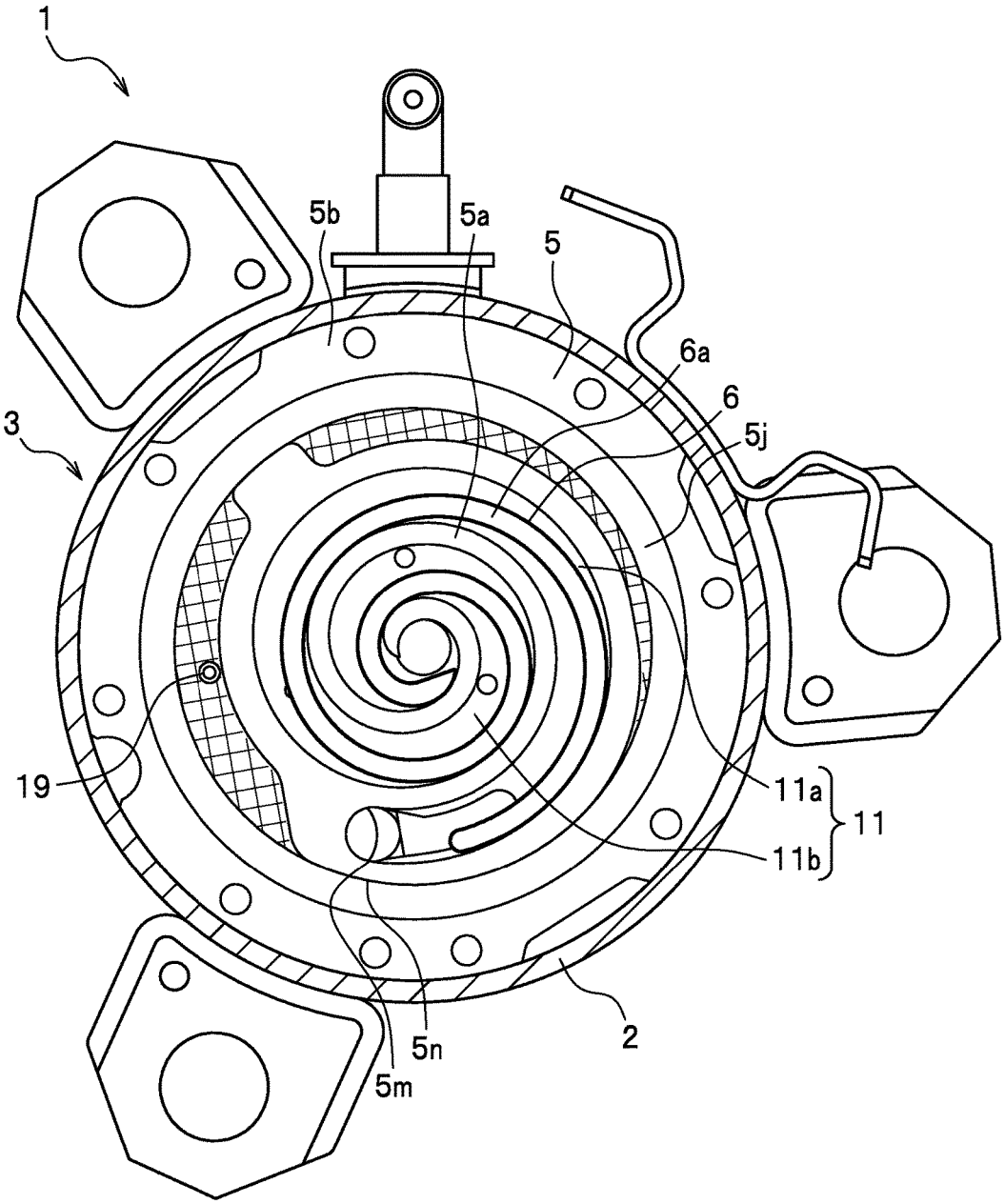
FIG. 3 is an explanatory view (1) for seal length.
Figure 4:
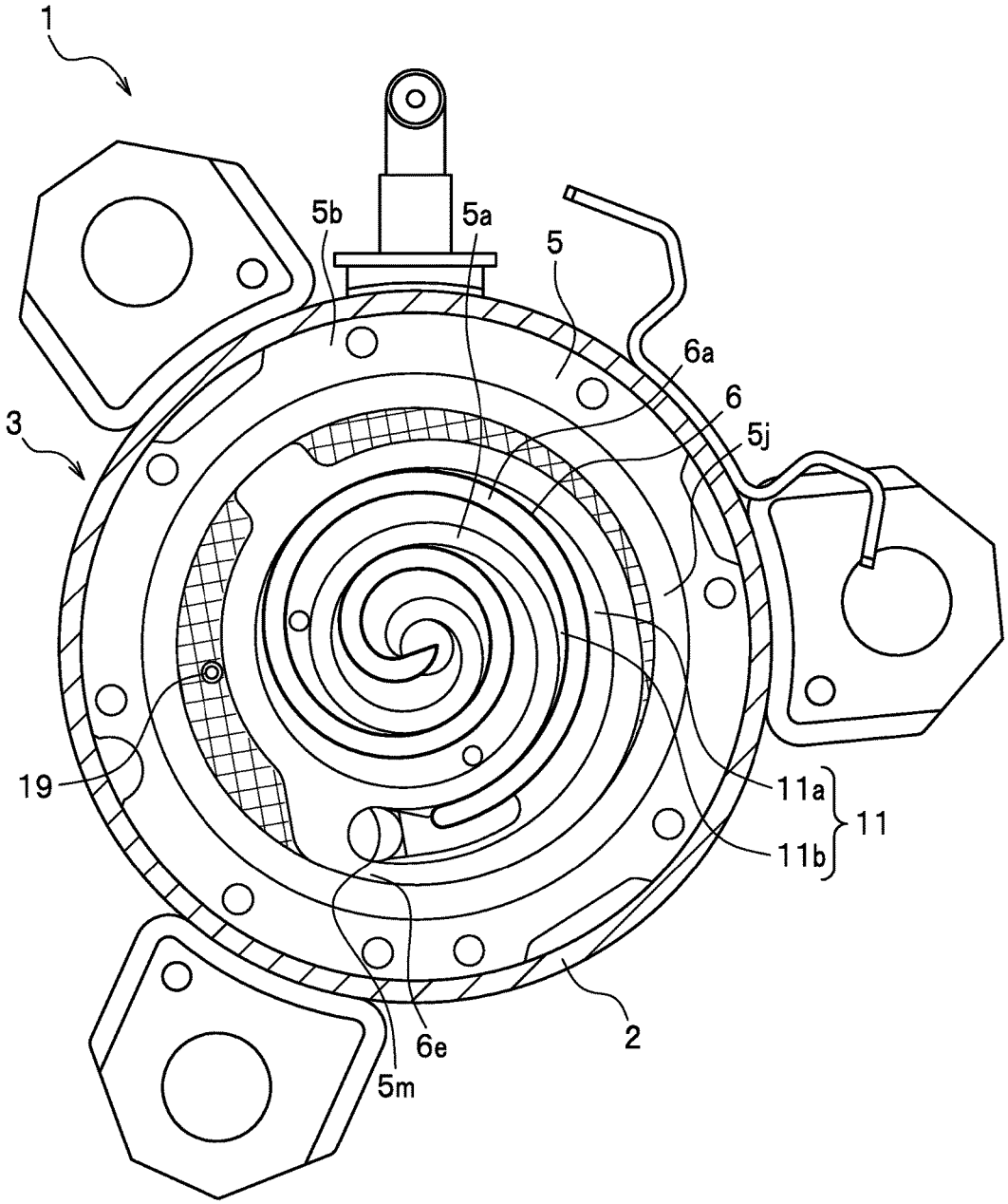
FIG. 4 is an explanatory view (2) for the seal length.

FIGS. 3 and 4 illustrate an example of the seal length. FIGS. 3 and 4 are explanatory views for the seal length. FIGS. 3 and 4 are different in the phase of the orbital motion of the orbiting scroll 6. In the example illustrated in FIG. 3, the axis of the orbiting scroll 6 is offset from the center to the lower right-hand side. The seal length in the vicinity of the suction chamber 5*c* is the distance between points 5*m* and 5*n*. In the example illustrated in FIG. 4, the axis of the orbiting scroll 6 is offset from the center to the upper left-hand side. The seal length in the vicinity of the suction chamber 5*c* is the distance between the point 5*m* and a point 6*e*.

Herein, the point 5*m* (see FIGS. 3 and 4) is a point on the outermost circumference in the inner curve of the fixed scroll 5. The position of the point 5*m* is at an end of an inside involute curve Liv (see FIG. 6) of the fixed scroll 5. The point 5*n* (see FIG. 3) is a point on the inner circumference of an annular groove 5*j*, which is provided in the sliding surface 5*f* of the fixed scroll 5. The point 6*e* (see FIG. 4) is a point on the outer circumference of the sliding plate 6*b* of the orbiting scroll 6. In the example illustrated in FIG. 4, since the axis of the orbiting scroll 6 is offset from the center to the upper left-hand side, the outer circumference of the sliding plate 6*b* of the orbiting scroll 6 is located at the position of the point 6*e*.

As illustrated in FIGS. 3 and 4, the seal length changes depending on the phase of the orbital motion of the orbiting scroll 6. The seal length at each phase is the shorter one of the distance between the points 5*m* and 5*n* (see FIG. 3) and the distance between the points 5*m* and point 6*e* (see FIG. 4). When the later-described annular groove 5*j* is not provided, the seal length is the distance between the points 5*m* and 6*e*. The seal length changes by double the orbiting radius while the orbiting scroll 6 orbits once. In this description, it is assumed that the seal length is the minimum value while the orbiting scroll 6 orbits once for convenience.

The shorter the seal length, the more difficult it is to maintain the sealing performance between the sliding surfaces 5*f* and 6*f*, and the more the refrigerant leakage loss. The seal length depends on the location of the seal portion between the sliding surfaces 5*f* and 6*f*.

In the scroll compressor 1, as described later, it is difficult to secure sufficient seal length in the vicinity of the suction chamber 5*c*, and the seal length is the shortest in the vicinity of the suction chamber 5*c*. In the scroll compressor 1, the amount of refrigerant leakage in the vicinity of the suction chamber 5*c* is greater than that in the other part of the sliding surface 5*f*.

In the scroll compressor 1, the difference in pressure between both sides of the seal portion in the vicinity of the suction chamber 5*c* is the differential pressure between the backpressure and suction pressure. On the other hand, the difference in pressure between the both sides of the other part in the sliding surface 5*f* is the differential pressure between the backpressure and the pressure within the compression chambers 5*e*. From the influence of these differential pressures, in the scroll compressor 1, the amount of refrigerant leakage in the vicinity of the suction chamber 11 is greater than that in the other part of the sliding surface 5*f*.

Figure 5:
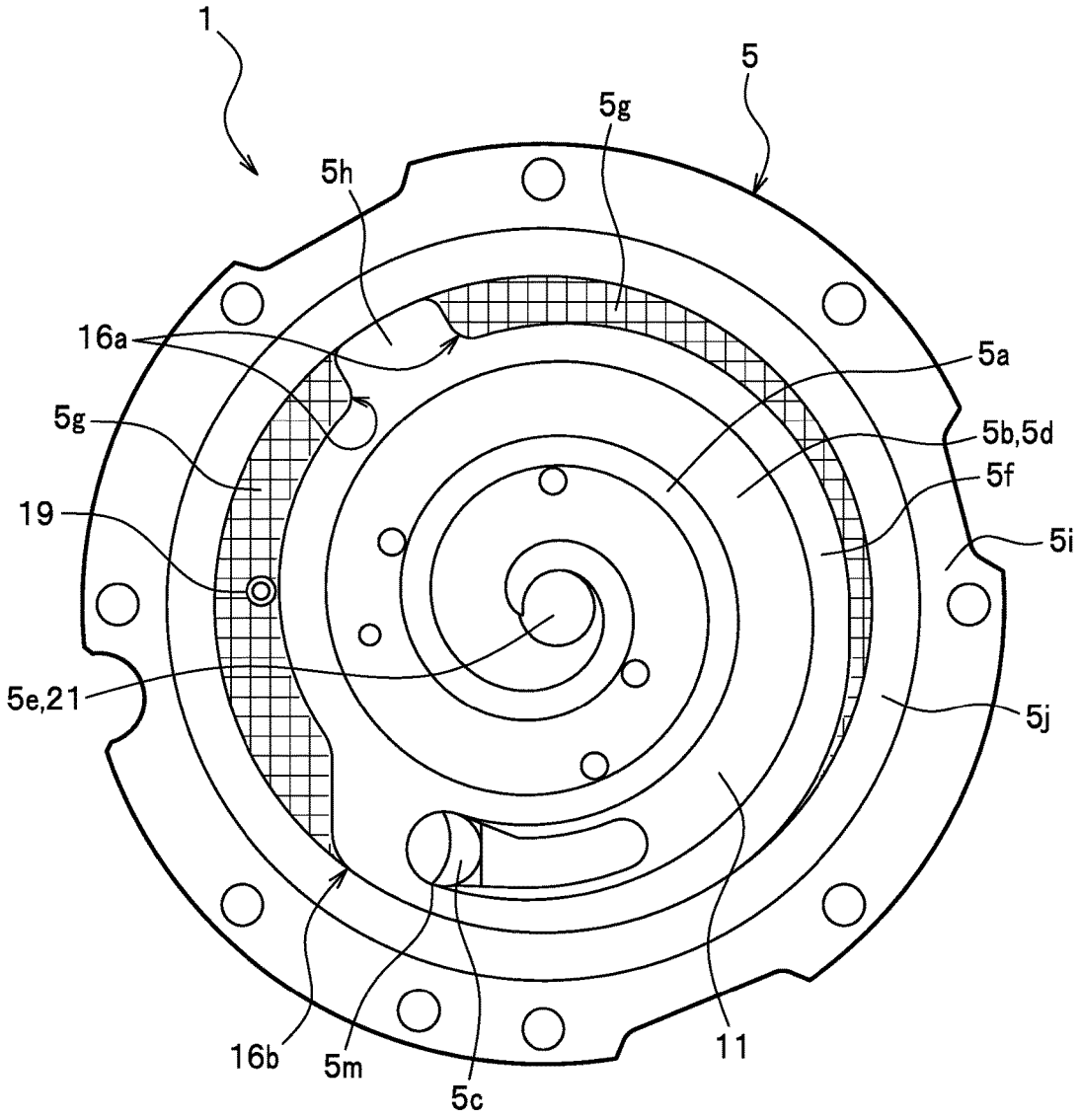
FIG. 5 is a schematic view (1) of a fixed scroll of the scroll compressor according to Embodiment 1.

The scroll compressor 1 therefore includes the depression sections 5*g*, that function as a backpressure introduced space to which the pressure (backpressure) of the backpressure chamber 10 is introduced, in the sliding surface 5*f* of the fixed scroll 5 or the sliding surface 6*f* of the orbiting scroll 6. For example, in the scroll compressor 1, the depression sections 5*g* are provided in the sliding surface 5*f* of the fixed scroll 5 as illustrated in FIG. 5. FIG. 5 is a schematic view of the fixed scroll 5 of the scroll compressor 1, illustrating the shape of the sliding surface 5*f* of the fixed scroll 5.

Each depression section 5*g* is a step provided for the sliding surface 5*f* of the fixed scroll 5. The depression sections 5*g* are depressed with respect to the sliding surface 5*f*. The depression sections 5*g* function as the backpressure introduced space. In Embodiment 1, each depression section 5*g* extends from the annular groove 5*j* to the sliding surface 5*f*. In the scroll compressor 1, providing the depression sections 5*g* for the sliding surface 5*f* of the fixed scroll 5 increases the pressure (backpressure) applied to the depression sections 5*g*. In the scroll compressor 1, the pressing force is increased in the region between the sliding surfaces 5*f* and 6*f* where a larger amount of refrigerant leaks, so that the reduction in refrigerant leakage loss is enhanced.

Meanwhile, there can be a scroll compressor in which the backpressure is simply increased without providing the depression sections 5*g* in order to press the orbiting scroll 6 against the fixed scroll 5 strongly. However, in the thus-configured scroll compressor, since the backpressure is increased, the amount of the lubricant 13 flown into the suction chamber 5*c* decreases. This results in an increase in sliding loss between the sliding surfaces 5*f* and 6*f* of the fixed scroll 5 and the orbiting scroll 6.

In the scroll compressor 1 according to Embodiment 1, the depression sections 5*g* are provided for the sliding surface 5*f* or 6*f* that can produce a large sliding loss. The area of contact between the sliding surface 5*f* of the fixed scroll 5 and the sliding surface 6*f* of the orbiting scroll 6 is thereby reduced, so that the reduction in sliding loss is enhanced.

<Detailed Description of Fixed Scroll Construction>

Figure 6:
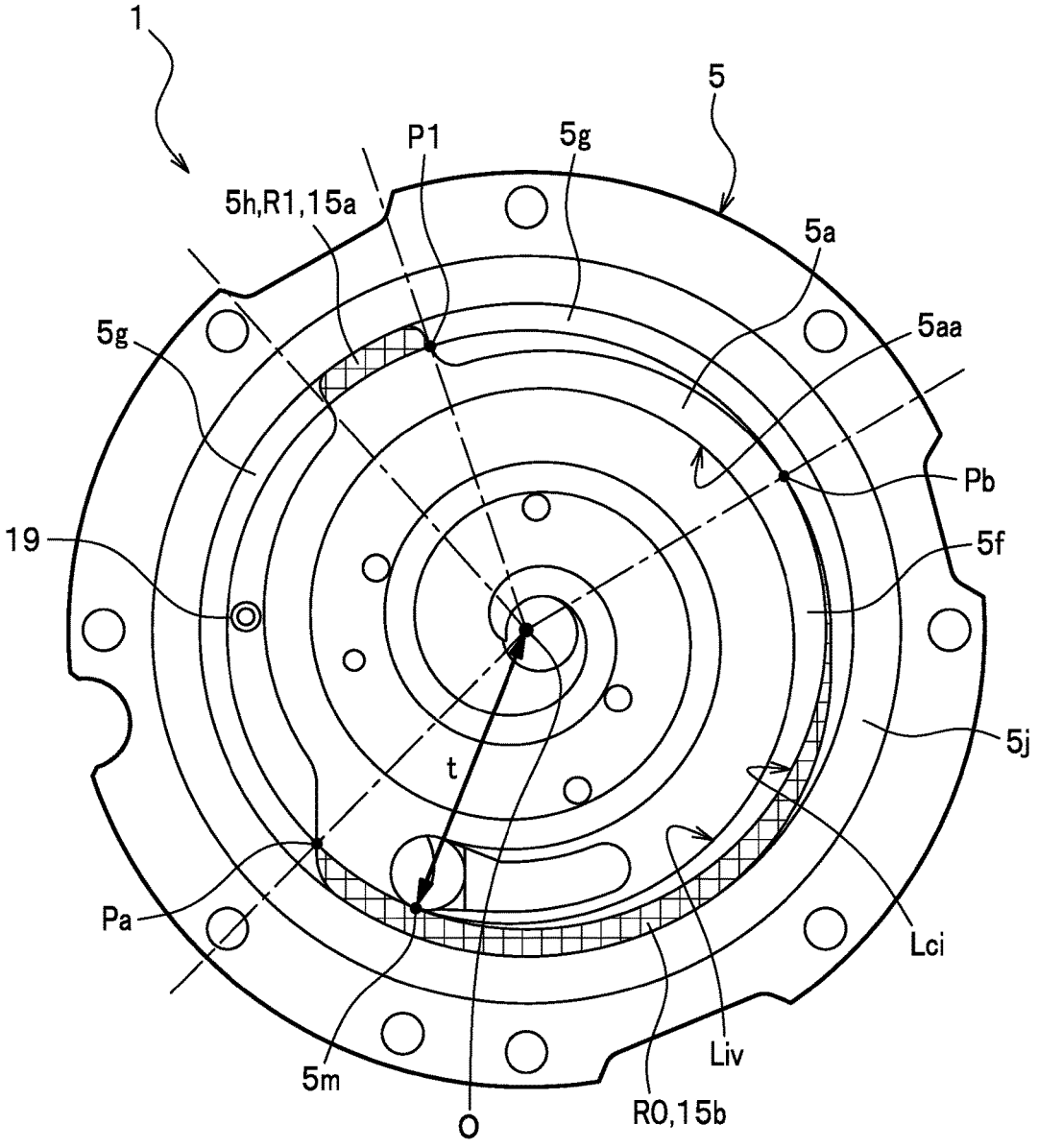
FIG. 6 is a schematic view (2) of the fixed scroll of the scroll compressor according to Embodiment 1.

Hereinafter, the construction of the fixed scroll 5 will be described in detail with reference to FIGS. 5 and 6. FIG. 6 is a schematic view of the fixed scroll 5 of the scroll compressor 1, illustrating the shape of the sliding surface 5*f* of the fixed scroll 5 similarly to FIG. 5.

As illustrated in FIG. 5, the fixed scroll 5 includes the support section 5*i*, the annular groove 5*j*, the sliding surface 5*f*, and the wrap 5*a*, which are sequentially arranged from the outside. To the support section 5*i*, fastening devices, such as the bolts 8, to fix the fixed scroll 5 to the frame 9 are attached. The wrap 5*a* is wound in a spiral manner toward the center, including the inner sidewall of the sliding surface 5*f* as a part.

The annular groove 5*j* is a step provided on the outer periphery of the sliding surface 5*f* of the fixed scroll 5 so as to face the backpressure space. The annular groove 5*j* is depressed with respect to the sliding surface 5*f*. The annular groove 5*j* includes a surface different in level from the sliding surface 5*f* by a predetermined amount. When the orbiting scroll 6 orbits, the end of the sliding surface 6*f* of the orbiting scroll 6 passes over the annular groove 5*j*. In this process, the sliding surface 6*f* of the orbiting scroll 6 is opened to the backpressure space since the annular groove 5*j* faces the backpressure space. The scroll compressor 1 may be configured so that the annular groove 5*j* is not provided for the fixed scroll 5.

In the example illustrated in FIG. 5, the depression sections 5*g* include two depression sections 5*g* provided for the sliding surface 5*f* of the fixed scroll 5. The depression sections 5*g* are opened to the annular groove 5*j* and each form a space communicating with the backpressure chamber 10 without reducing the backpressure. The depression sections 5*g* are disposed on the inside of the annular groove 5*j* in the sliding surface 5*f* of the fixed scroll 5. The depression sections 5*g* are also provided so as to protrude inward across the later-described inside involute curve Liv.

Each of the depression sections 5*g* has a shape obtained by expanding a part of the annular groove 5*j* into the sliding surface 5*f*. In other words, each depression section 5*g* is an extension of the width of the annular groove 5*j* toward the center. The depression sections 5*g* are formed in a part of the sliding surface 5*f* other than a later-described region R0 (see FIG. 6). The region R0 (see FIG. 6) is a seal portion provided to prevent refrigerant leakage in the vicinity of the suction chamber 5*c*. The width of the region R0 (see FIG. 6) in the vicinity of the suction chamber 5*c* is set equal to or greater than the wall thickness of the wrap 5*a* which is needed to prevent the refrigerant leakage. In the thus-configured scroll compressor 1, even if the annular groove 5*j* is not provided for the fixed scroll 5, the backpressure is introduced to the depression sections 5*g* provided in the sliding surface 5*f*. Even if the scroll compressor 1 has such a structure, the pressing force is increased in a region between the sliding surfaces 5*f* and 6*f* where a large amount of the refrigerant leaks, that enhances reducing the refrigerant leakage loss.

The fixed scroll 5 includes a flange section 5*h* between the two depression sections 5*g*. The flange section 5*h* is a step provided in the outer periphery of the sliding surface 5*f* of the fixed scroll 5. The flange section 5*h* is elevated with respect to the depression sections 5*g*. The surface level of the flange section 5*h* is equal to or slightly lower than the sliding surface 5*f*.

Herein, the flange section refers to a remaining region of a protruding region of the sliding surface that are disposed outside of a referential perfect circle, other than the region continuing to the end of the involute curve of the scroll where the flange section is formed. The referential perfect circle has a radius set to the distance between the center of the scroll of interest and the end of the involute curve. When the flange section is provided for the fixed scroll, the involute curve of the scroll is the inside involute curve of the fixed scroll. When the flange section is provided for the orbiting scroll, the involute curve of the scroll is the outside involute curve of the orbiting scroll.

In the example illustrated in FIG. 6, for example, the flange section 5*h* corresponds to a remaining region R1, which is in the regions (the regions R0 and R1 in the illustrated example) disposed outside of the perfect circle Lci in the sliding surface 5*f*, other than the region R0, which continues to the end point 5*m* of the inside involute curve Liv.

Herein, the perfect circle Lci refers to a circle with a radius set to a distance t between the center O of the fixed scroll 5 and the end point 5*m* of the inside involute curve Liv of the fixed scroll 5.

The inside involute curve Liv refers to a curve that defines the profile of an inner wall surface 5*aa* of the wrap 5*a* of the fixed scroll 5. The inner wall surface 5*aa* of the wrap 5*a* of the fixed scroll 5 is formed along the inside involute curve Liv.

The region R0 is a part of the sliding surface 5*f* and is disposed outside of the perfect circle Lci in the sliding surface 5*f* of the fixed scroll 5 in order to secure the seal length in the vicinity of the suction chamber 5*c*.

The region R1 is a part of the sliding surface 5*f* and is disposed outside of the perfect circle Lci in the sliding surface 5*f* of the fixed scroll 5 in order to reduce the upsetting moment of the orbiting scroll 6.

In the aforementioned construction, the scroll compressor 1 includes the protruding region R0, which is disposed outside of the perfect circle Lci, in the sliding surface 5*f* of the fixed scroll 5 in order to secure the seal length in the vicinity of the suction chamber 5*c*. The scroll compressor 1 also includes the depression sections 5*g* in the sliding surface 5*f* of the fixed scroll 5, which is disposed outside of the wrap 5*a*, in order to reduce the sliding loss during operation. However, the protruding region R0 and depression sections 5*g* upsets the balance at supporting the orbiting scroll 6, making the orbiting scroll 6 more likely to swing. The scroll compressor 1 according to Embodiment 1 therefore includes the elevated flange section 5*h* in the sliding surface 5*f* of the fixed scroll 5 in order to prevent the orbiting scroll 6 from swinging.

In the example illustrated in FIG. 6, an end of the flange section 5*h* on the upstream side and an end thereof on the downstream side are located at 120 degrees or less from both two intersections Pa and Pb at which the sliding surface 5*f* intersect with the perfect circle Lci. Herein, the upstream and downstream sides are defined based on the direction that the refrigerant flows in the compression chambers 11.

The flange section 5*h* (region R1) is provided so that an area 15*a* thereof is always smaller than an area 15*b* of the region R0. The width of the flange section 5*h* (region R1) is preferably not greater than 20 mm in the light of the magnitude of the region R0 and the magnitude of the depression sections 5*g*, which function as the backpressure introduced space.

Figure 12:
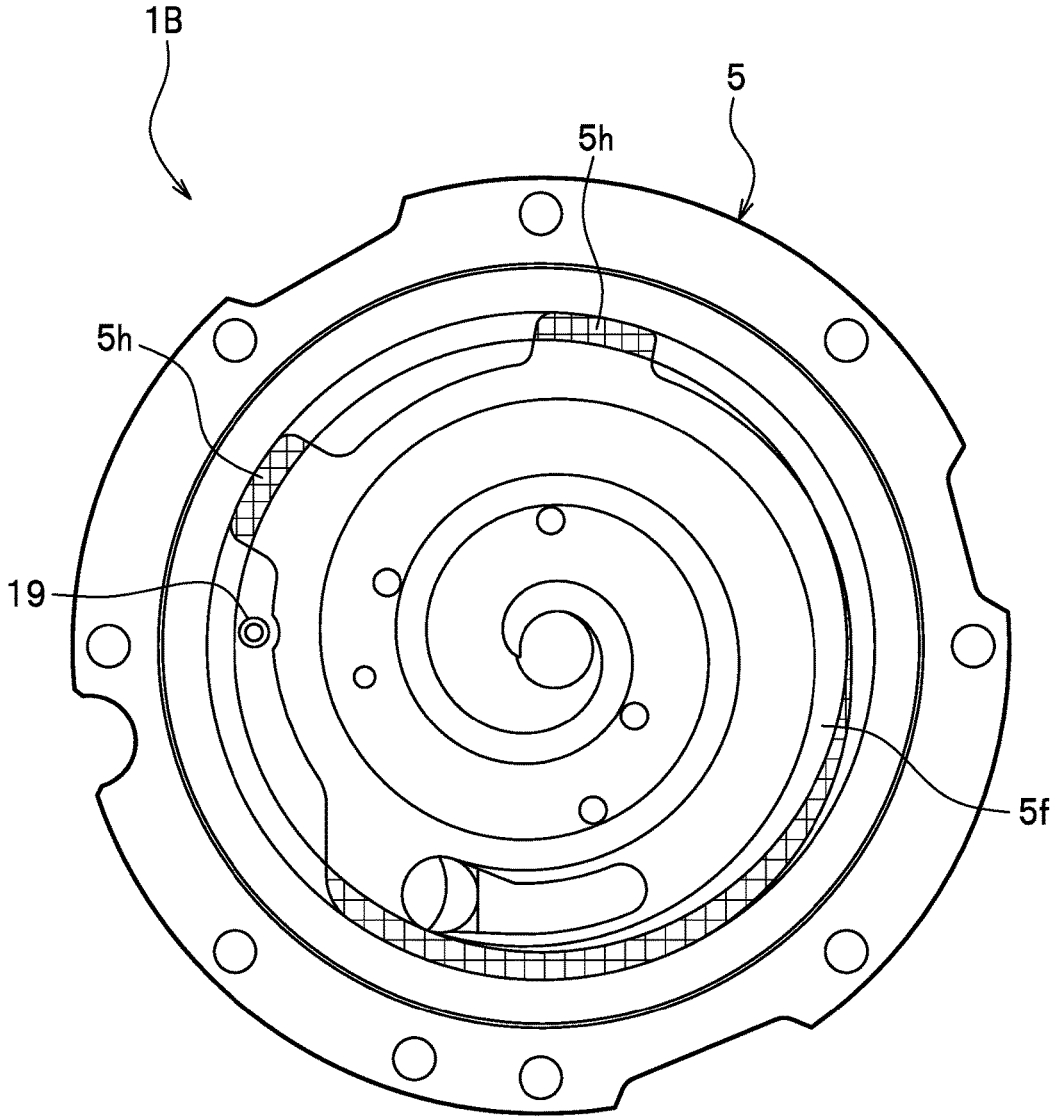
FIG. 12 is a schematic view of a fixed scroll of a scroll compressor according to Embodiment 3.

As described above, the lubrication hole 19 for supplying the lubricant 13 is provided in the outer periphery of the fixed scroll 5. The lubrication hole 19 is disposed within the flange section 5*h* or in the vicinity thereof. The lubrication hole 19 is preferably located downstream of a point P1 in order to supply the lubricant 13 around the flange section 5*h* that produces frictional resistance between the sliding surface 5*f* of the fixed scroll 5 and the sliding surface 6*f* of the orbiting scroll 6. The point P1 is the point where the perfect circle Lci and the flange section 5*h* (region R1) intersect first. When the fixed scroll 5 includes a plurality of flange sections 5*h* as illustrated in FIG. 12, for example, the point where the perfect circle Lci and the flange section 5*h* (region R1) intersect first (that is, the point P1) indicates a point where the most upstream flange section 5*h* intersects with the perfect circle Lci.

At the end of the tooth bottom 5*d* in the base plate 5*b* of the fixed scroll 5, the suction chamber 5*c* is provided. The suction chamber 5*c* is located in the vicinity of the end point 5*m* of the inside involute curve Liv of the fixed scroll 5. The end point 5*m* is located on the edge of the inner circumference of the suction port of the suction chamber 5*c*. The fixed scroll 5 has a structure in which the radial length of the wrap 5*a* is short in the vicinity of the suction chamber 5*c* since the suction chamber 5*c* is located near the end point 5*m*. This means that it is difficult to secure sufficient seal length in the vicinity of the suction chamber 5*c*.

<Operation of Flange Section>

Figure 7:
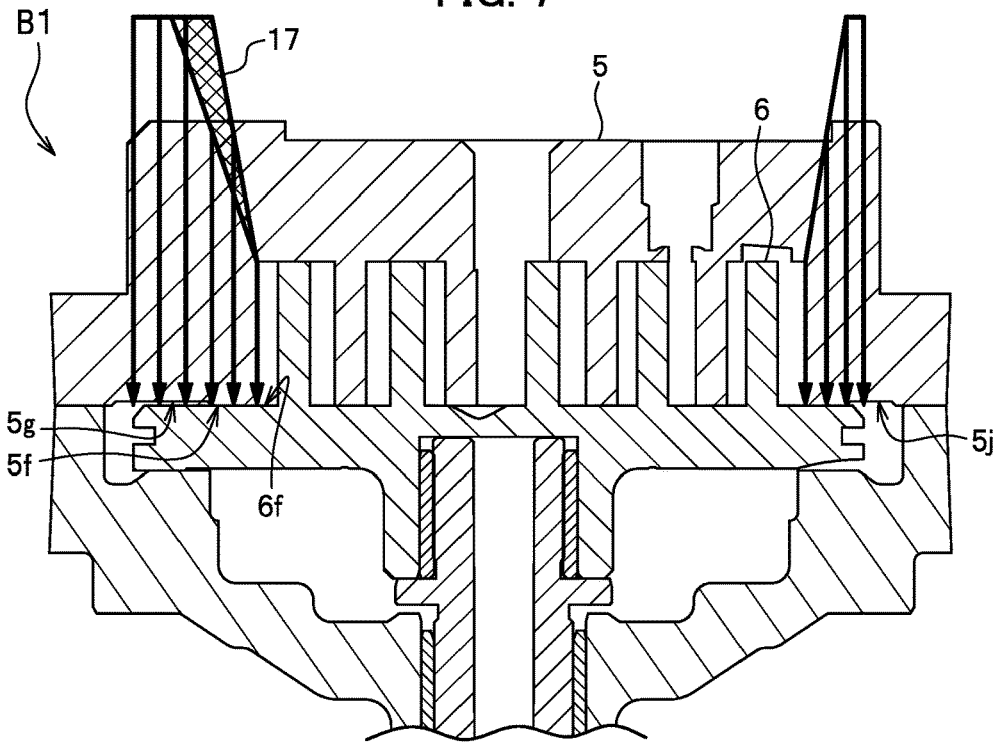
FIG. 7 is a schematic diagram illustrating a distribution of load applied to a sliding surface of an orbiting scroll of a scroll compressor according to a comparative example.
Figure 8:
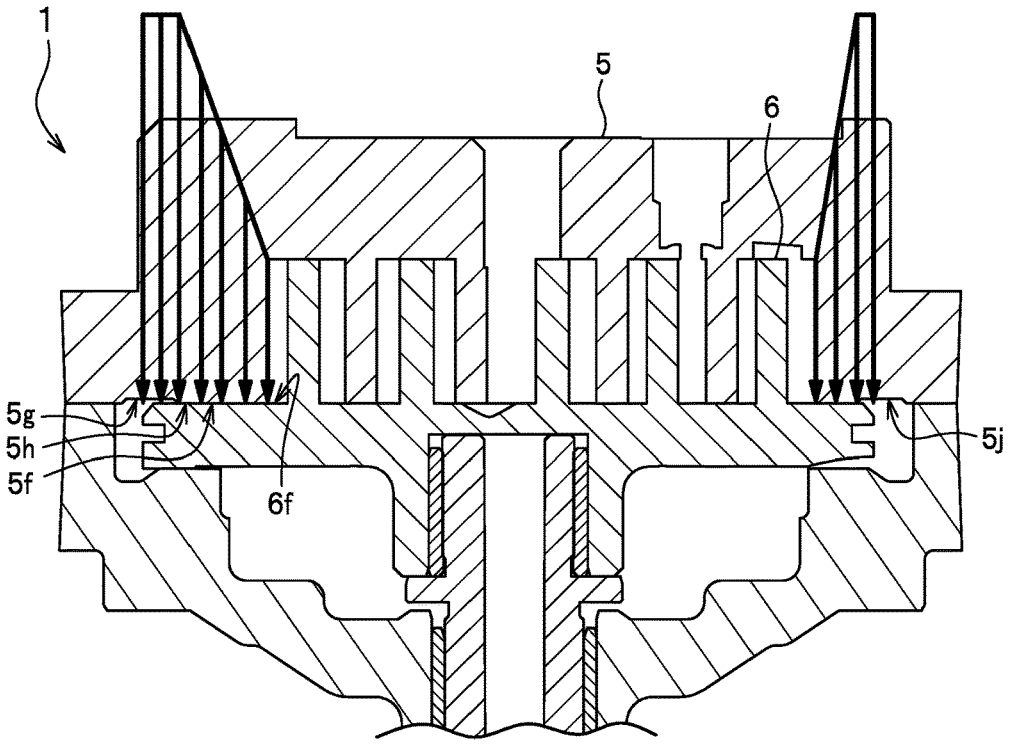
FIG. 8 is a schematic diagram illustrating a distribution of load applied to the sliding surface of an orbiting scroll of the scroll compressor according to Embodiment 1.

Hereinafter, the operation of the flange section 5*h* will be described with reference to FIGS. 7 and 8. FIG. 7 is a schematic diagram illustrating a distribution of load applied to a sliding surface 6*f* of an orbiting scroll 6 of a scroll compressor B1 according to a comparative example. The scroll compressor B1 according to the comparative example corresponds to the conventional scroll compressor described in Patent Literature 1. FIG. 8 is a schematic diagram illustrating a distribution of load applied to the sliding surface 6*f* of the orbiting scroll 6 of the scroll compressor 1 according to Embodiment 1.

As illustrated in FIG. 7, the scroll compressor B1 according to the comparative example differs from the scroll compressor 1 (see FIG. 8) according to Embodiment 1 in that the flange section 5*h* is not provided for the sliding surface 5*f* of the fixed scroll 5.

As illustrated in FIG. 7, in the scroll compressor B1 according to the comparative example, the depression sections 5*g* are provided in the sliding surface 5*f* of the fixed scroll 5. In the thus-configured scroll compressor B1, the pressure within the depression sections 5*g* is the backpressure. In the scroll compressor B1, force that presses down the sliding surface 6*f* of the orbiting scroll 6 is increased in the portion corresponding to the depression section 5*g* by a load increase 17 (expressed by a triangle) compared with the case where the depression sections 5*g* are not provided for the sliding surface 5*f* of the fixed scroll 5. In the scroll compressor B1, another force that presses down the portion of the sliding surface 6*f* of the orbiting scroll 6 that corresponds to the depression sections 5*g* is produced in addition to the upsetting moment. In the scroll compressor B1, therefore, the orbiting scroll 6 is more likely to swing. The refrigerant leakage can be reduced especially in the vicinity of the suction chamber 5*c* where the seal length is short in the scroll compressor B1. On the other hand, in the scroll compressor B1, the orbiting scroll 6 is more likely to swing. In the scroll compressor B1, therefore, the difference in pressure between both sides of the seal portion in the place other than the vicinity of the suction chamber 5*c*, for example, is differential pressure between the backpressure and suction pressure. This can increase the amount of refrigerant leakage in the place other than the vicinity of the suction chamber 5*c*.

In the scroll compressor 1 according to Embodiment 1, as illustrated in FIG. 8, the depression sections 5*g* are provided in the sliding surface 5*f* of the fixed scroll 5 similarly to the scroll compressor B1 according to the comparative example. In the scroll compressor 1 according to Embodiment 1, the flange section 5*h* is additionally provided in the sliding surface 5*f* of the fixed scroll 5.

In the fixed scroll 5 of the thus-configured scroll compressor 1, the pressing force of the orbiting scroll 6 composed of the backpressure is born at the plurality of places including the flange section 5*h* and other portions in the sliding surface 5*f*. Accordingly, even if the force that presses down the sliding surface 6*f* of the orbiting scroll 6 increases in the portion corresponding to the depression sections 5*g*, the pressing force from the orbiting scroll 6 composed of the backpressure and the upsetting moment are reduced in the scroll compressor 1, in contrast to the scroll compressor B1 according to the comparative example. Accordingly, in the scroll compressor 1, compared with the scroll compressor B1 according to the comparative example, the orbiting scroll 6 is prevented from swinging while the refrigerant leakage is reduced in the vicinity of the suction chamber 5*c* where the seal length is short as well as in the entire compression chambers 11.

The above-described operation of the flange section 5*h* is obtained irrespectively of the phase of the orbital motion of the orbiting scroll 6. In the scroll compressor 1, therefore, the reduction in sliding loss can be enhanced even when the radial width of the seal portion (the region R0, see FIG. 6) in the vicinity of the suction chamber 5*c* is equal to or greater than the wall thickness of the wrap 5*a* that is needed to prevent the refrigerant leakage.

As illustrated in FIG. 5, connecting sections 16*a* between the flange section 5*h* and depression sections 5*g* and a connecting section 16*b* between the flange section 5*h* and annular groove 5*j* are preferably formed in a smooth circular shape so as to minimize sharp edges. Since the sliding surface 5*f* does not include any sharp edge, the sliding surfaces 5*f* and 6*f* are prevented from being damaged even if the orbiting scroll 6 tilts due to swinging motion of the orbiting scroll 6 and the sliding surface 6*f* comes into contact with the sliding surface 5*f*.

<Modification>

Figure 9:
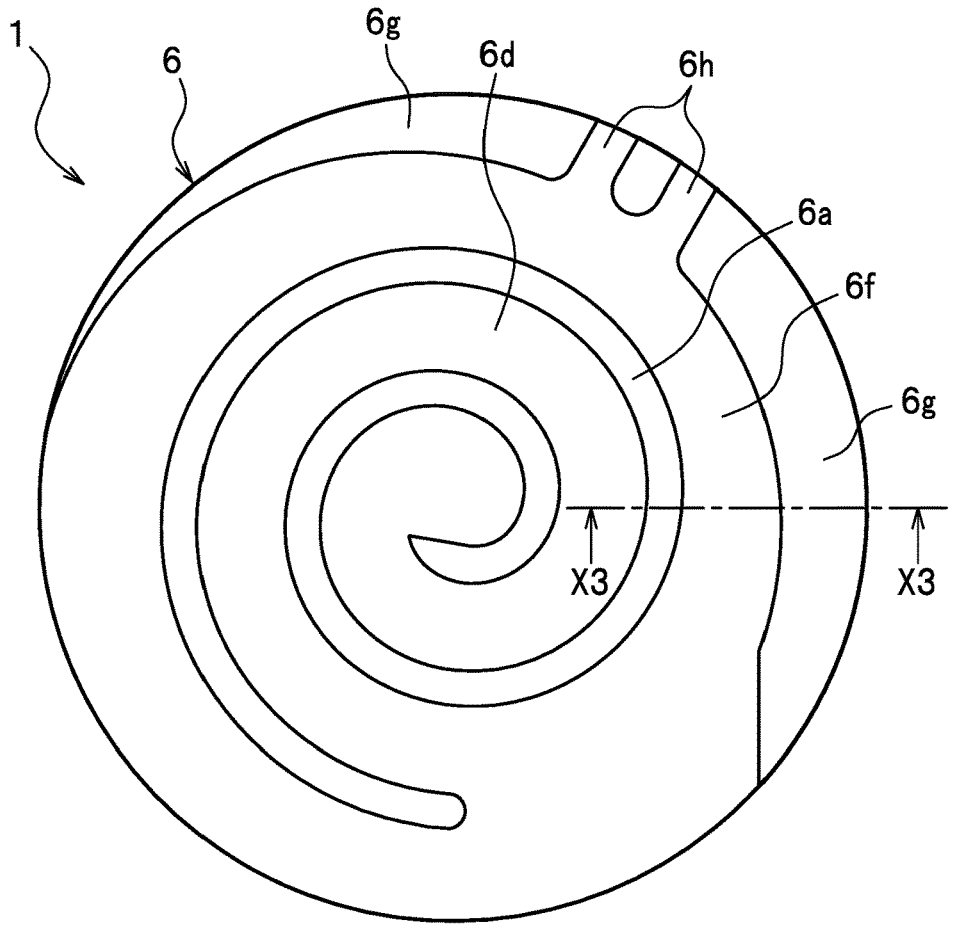
FIG. 9 is a schematic view of an orbiting scroll according to a modification of Embodiment 1.

In the construction illustrated in FIGS. 5 and 6, the scroll compressor 1 includes the depression sections 5*g* and flange section 5*h* in the sliding surface 5*f* of the fixed scroll 5. As illustrated in FIG. 9, for example, the scroll compressor 1 may include depression sections 6*g* and a flange section 6*h* in the sliding surface 6*f* of the orbiting scroll 6 instead of including the depression sections 5*g* and flange section 5*h* in the sliding surface 5*f* of the fixed scroll 5. FIG. 9 is a schematic view of the orbiting scroll 6 according to a modification. FIG. 9 illustrates the construction of the orbiting scroll 6 according to the modification along a line X2-X2 of FIG. 1 when viewed from above.

Figure 10:
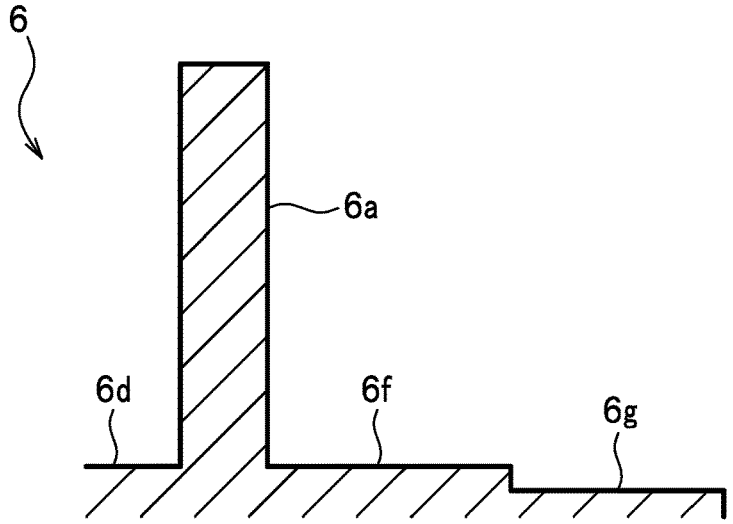
FIG. 10 is a longitudinal sectional view of the orbiting scroll according to the modification of Embodiment 1.

As illustrated in FIG. 9, in the modification, the depression sections 6*g* include two depression sections 6*g*, and the flange section 6*h* includes one flange section 6*h*. The two depression sections 6*g* and one flange section 6*h* are disposed in the sliding surface 6*f* of the orbiting scroll 6. The side view of one of the depression sections 6*g* is illustrated in FIG. 10. FIG. 10 is a longitudinal sectional view of the orbiting scroll 6 according to the modification. FIG. 10 illustrates the construction of the section taken along a line X3-X3 of FIG. 9 when seen from the side.

Each depression section 6*g* is a step provided in the sliding surface 6*f* of the orbiting scroll 6. As illustrated in FIG. 10, the depression sections 6*g* are depressed with respect to the sliding surface 6*f*. The depression sections 6*g* function as the backpressure introduced space in the same way as the depression sections 5*g* (see FIGS. 5 and 6). In the scroll compressor 1, providing the depression sections 6*g* in the sliding surface 6*f* of the orbiting scroll 6 increases the pressure (backpressure) applied to the depression sections 6*g*. In the scroll compressor 1, therefore, the pressing force is increased in the region between the sliding surfaces 5*f* and 6*f* where a large amount of refrigerant leaks, so that the reduction in refrigerant leakage loss is enhanced especially in the vicinity of the suction port 5*c*.

The orbiting scroll 6 according to the modification includes the flange section 6*h* between the two depression sections 6*g*. The flange section 6*h* is a step provided in the outer periphery of the sliding surface 6*f* of the orbiting scroll 6. The flange section 6*h* is elevated with respect to the depression sections 6*g*. The surface level of the flange section 6*h* is equal to or slightly lower than that of the sliding surface 6*f*.

The flange section 6*h* is disposed in the sliding surface 6*f* based on a referential perfect circle with the radius set to the distance between the center of the orbiting scroll 6 in which the flange section 6*h* is formed and the end of the outside involute curve of the orbiting scroll 6. Specifically, the flange section 6*h* is provided as a remaining region of the protruding regions disposed outside of the referential perfect circle, other than the region continuing to the end of the outside involute curve.

In the above-described construction, the depression sections 6*g* function as the backpressure introduced space to introduce the pressure (backpressure) of the backpressure chamber 10 to the sliding surfaces 5*f* and 6*f* in the same way as the depression sections 5*g* (see FIGS. 5 and 6). The flange section 6*f* bears the pressing force of the orbiting scroll 6 in the same way as the flange section 5*h* (see FIGS. 5 and 6).

Even when the depression sections 6*g* and flange section 6*h* are provided in the sliding surface 6*f* of the orbiting scroll 6 like the modification, the scroll compressor 1 provides the same operation as that in the case where the depression sections 5*g* and flange section 5*h* are provided in the sliding surface 5*f* of the fixed scroll 5 (see FIGS. 5 and 6). Herein, the same operation includes preventing the orbiting scroll 6 from swinging while reducing the refrigerant leakage in the vicinity of the suction chamber 5*c* where the seal length is short as well as reducing the refrigerant leakage in the entire compression chambers 11.

<Major Features of Scroll Compressor>

(1) In the scroll compressor 1, the sliding surface 5*f* of the fixed scroll 5 is formed outside of the wrap 5*a* with the depression sections 5*g*, which are depressed with respect to the sliding surface 5*f*, and the flange section 5*h*, which is elevated with respect to the depression sections 5*g*. Alternatively, the sliding surface 6*f* of the orbiting scroll 6 is formed outside of the wrap 6*a* with the depression sections 6*g*, which are depressed with respect to the sliding surface 6*f*, and the flange section 6*h*, which is elevated with respect to the depression sections 6*g*. The flange section is a remaining region provided in the protruding regions disposed outside of the referential perfect circle, other than the region continuing to the end of the involute curve of the scroll formed withe the flange section. The referential perfect circle has a radius set to a distance between the center of the scroll formed with the flange section and the end of the involute curve of the scroll.

Thus-configured scroll compressor 1 prevents the orbiting scroll 6 from swinging due to the upsetting moment to enhance reducing the sliding loss with the simple structure as well as enhance reducing the refrigerant leakage loss in the entire compression chambers 11.

(2) The area 15*a* of the flange section 5*h*, that corresponds to the protruding region R1 among the protruding regions R0 and R1 (see FIG. 6), is smaller than the area 15*b* of the protruding region R0, which corresponds to the region continuing to the end of the involute curve. In the thus-configured scroll compressor 1, the sliding loss is efficiently reduced.

(3) The lubrication hole 19 (see FIG. 6) is disposed downstream of the intersection P1, at which the perfect circle Lci (see FIG. 6) and the flange section 5*h* intersect first. In the thus-configured scroll compressor 1, providing the flange section 5*h* in the place where a large amount of lubricant is supplied reduces the sliding loss due to the flange section 5*h*. The same goes with the flange section 6*h* (see FIG. 9).

(4) The width of the flange section 5*h* (see FIG. 6) is preferably 20 mm or less. In the thus-configured scroll compressor 1, the sliding loss due to the flange section 5*h* is reduced. The same goes with the flange section 6*h* (see FIG. 9).

As described above, with the scroll compressor 1 according to Embodiment 1, it is possible to prevent the orbiting scroll 6 from swinging due to the upsetting moment with the simple structure to enhance reducing the sliding loss as well as enhance reducing the refrigerant leakage loss in the entire compression chambers 11.

Embodiment 2

Figure 11:
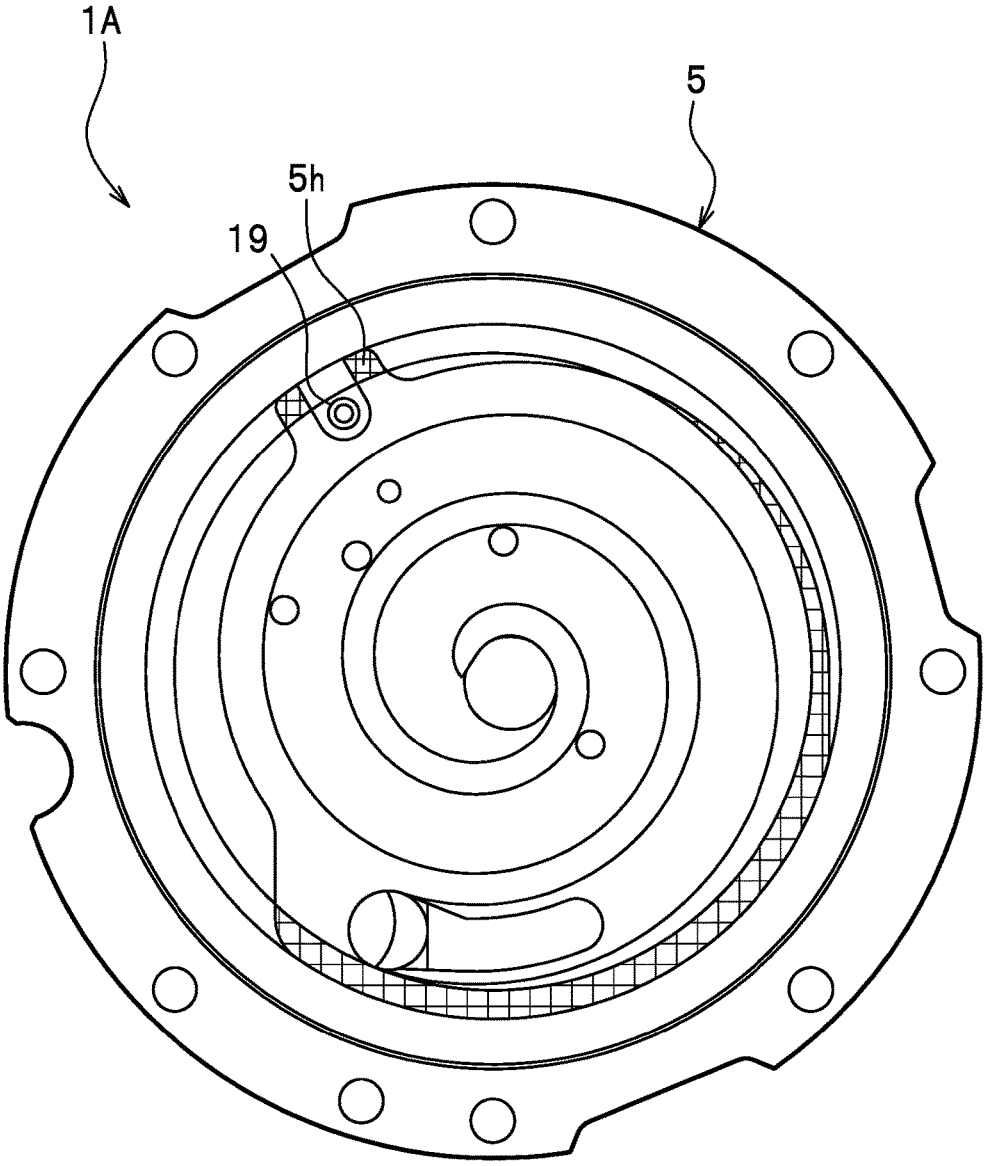
FIG. 11 is a schematic view of a fixed scroll of a scroll compressor according to Embodiment 2.

Hereinafter, the construction of a scroll compressor 1A according to Embodiment 2 will be described with reference to FIG. 11. FIG. 11 is an enlarged cross-sectional view of the fixed scroll 5 of the scroll compressor 1.

As illustrated in FIG. 11, the scroll compressor 1A differs from the scroll compressor 1 according to Embodiment 1 (see FIG. 5) in that the lubrication hole 19 is provided within the flange section 5*h*.

In the thus-configured scroll compressor 1A, similarly to the scroll compressor 1 according to Embodiment 1, it is possible to enhance reducing the sliding loss with the simple structure and enhance reducing the refrigerant leakage loss in the entire compression chambers 11.

In the scroll compressor 1A, the lubrication hole 19 is provided within the flange section 5*h*. The flange section 5*h* is therefore sufficiently supplied with the lubricant 13. This can reduce the sliding loss of the scroll compressor 1A more than that of the scroll compressor 1 according to Embodiment 1.

Embodiment 3

Hereinafter, the construction of a scroll compressor 1B according to Embodiment 3 will be described with reference to FIG. 12. FIG. 12 is an enlarged cross-sectional view of the fixed scroll 5 of the scroll compressor 1B.

As illustrated in FIG. 12, the scroll compressor 1B differs from the scroll compressor 1 (see FIG. 5) according to Embodiment 1 in that the sliding surface 5*f* is provided with a plurality of flange sections 5*h*.

In the thus-configured scroll compressor 1B, similarly to the scroll compressor 1 according to Embodiment 1, it is possible to enhance reducing the sliding loss with the simple structure and enhance reducing the refrigerant leakage loss in the entire compression chambers 11.

In the scroll compressor 1B, additionally, the plurality of flange sections 5*h* are provided in the sliding surface 5*f* and are able to bear the pressing force of the orbiting scroll 6 composed of larger backpressure than that in the scroll compressor 1 according to Embodiment 1. The pressing force and upsetting moment can be thereby efficiently reduced in the scroll compressor 1B. In other words, the stability of the orbiting scroll 6 is improved in the scroll compressor 1B. With the scroll compressor 1B, it is possible to prevent the orbiting scroll 6 from swinging and reduce the refrigerant leakage in the vicinity of the suction chamber 5*c* where the seal length is short as well as reduce the refrigerant leakage in the entire compression chambers 11.

Embodiment 4

Figure 13:
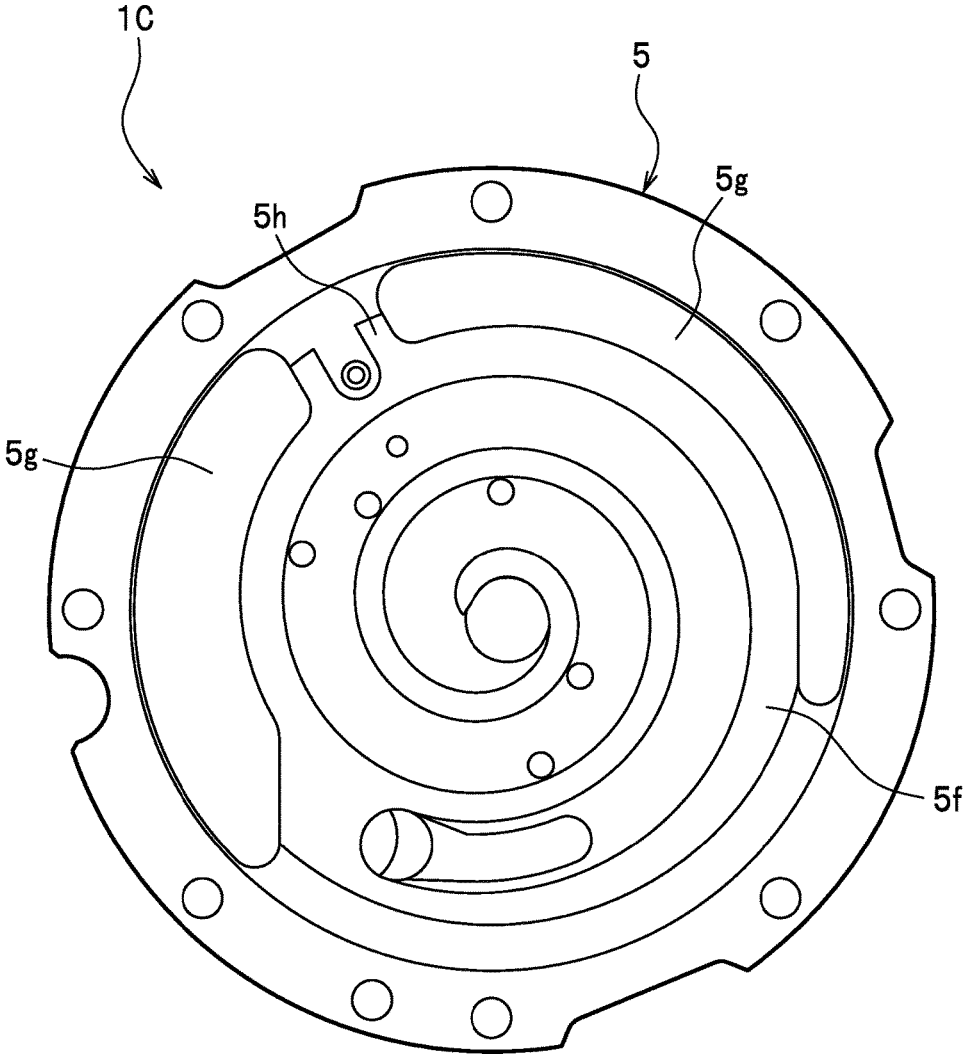
FIG. 13 is a schematic view of a fixed scroll of a scroll compressor according to Embodiment 4.

Hereinafter, the construction of a scroll compressor 1C according to Embodiment 4 will be described with reference to FIG. 13. FIG. 13 is an enlarged cross-sectional view of the fixed scroll 5 of the scroll compressor 1C.

As illustrated in FIG. 13, the scroll compressor 1C differs from the scroll compressor 1 (see FIG. 5) according to Embodiment 1 in that the depression sections 5*g* include a non-machining surface which is not machined.

The surface in the depression sections 5*g*, which have the non-machining surface, is rougher than the surface of the sliding surface. In the thus-configured scroll compressor 1C, the lubricant efficiently retains in the depression sections 5*g*. This improves the sealing performance between the sliding surface 5*f* of the fixed scroll 5 and the sliding surface 6*f* of the orbiting scroll 6. In addition, the depression sections 5*g* are partially not machined. This reduces the time and man-hours for the machining process of the scroll compressor 1C and reduces the manufacturing cost thereof.

In the thus-configured scroll compressor 1C, similarly to the scroll compressor 1 according to Embodiment 1, it is possible to enhance reducing the sliding loss with the simple structure and enhance reducing the refrigerant leakage loss in the compression chambers 11.

In the scroll compressor 1C, the sealing performance between the sliding surface 5*f* of the fixed scroll 5 and the sliding surface 6*f* of the orbiting scroll 6 can be improved more than that in the scroll compressor 1 according to Embodiment 1. In addition, compared with the scroll compressor 1 according to Embodiment 1, it is possible to significantly reduce the time and man-hours for the machining process of the scroll compressor 1C and reduce the manufacturing cost thereof.

The present invention is not limited to the aforementioned embodiments and includes various modifications. For example, the aforementioned embodiments are described in detail to explain the present invention for easy understanding, and the present invention is not limited to apparatuses including all of the configurations described above. In addition, a part of the configuration of each embodiment can be replaced with the configuration of another embodiment. Alternatively, the configuration of each embodiment can be added to the configuration of another embodiment. Furthermore, a part of the configuration of each embodiment can be subjected to addition, deletion, and replacement of another configuration.

REFERENCE SIGNS LIST

1, 1A, 1B, 1C SCROLL COMPRESSOR (COMPRESSOR)
2 SEALED CASING
2*a* CYLINDER CHAMBER
2*b* TOP CHAMBER
2*c* BOTTOM CHAMBER
2*d* SUCTION PIPE
2*e* DISCHARGE PIPE
2*f* DISCHARGE PRESSURE SPACE
3 COMPRESSION MECHANISM
4 ELECTRIC MOTOR
4*a* STATOR
4*b* ROTOR
5 FIXED SCROLL (FIXED MEMBER)
5*a*, 6*a* WRAP
5*aa* INNER WALL SURFACE
5*b* END PLATE (BASE PLATE)
5*c* SUCTION CHAMBER
5*d*, 6*d* TOOTH BOTTOM
5*e* DISCHARGE PORT
5*f*, 6*f* SLIDING SURFACE
5*g*, 6*g* DEPRESSION SECTION
5*h*, 6*h* FLANGE SECTION
5*i* SUPPORT SECTION
5*j* ANNULAR GROOVE
5*m* END OF INSIDE INVOLUTE CURVE OF FIXED SCROLL (POINT ON OUTERMOST CIRCUMFERENCE OF INNER CURVE OF FIXED SCROLL)
5*n* POINT ON INNER CIRCUMFERENCE OF ANNULAR GROOVE PROVIDED IN SLIDING SURFACE OF FIXED SCROLL
6 ORBITING SCROLL (MOVING SCROLL)
6*b* END PLATE (SLIDING PLATE)
6*c* ORBITING BEARING
6*e* POINT ON OUTER CIRCUMFERENCE OF SLIDING PLATE OF ORBITING SCROLL
6*i* BOSS SECTION
7 CRANKSHAFT
7*a* MAIN SHAFT
7*b* ECCENTRIC SECTION
7*c* LUBRICATION CHANNEL
8 BOLT
9 FRAME
9*a* MAIN BEARING
10 BACKPRESSURE CHAMBER
10*a* BACKPRESSURE REGULATION VALVE
11 COMPRESSION CHAMBER
11*a* ORBITING INSIDE COMPRESSION CHAMBER
11*b* ORBITING OUTSIDE COMPRESSION CHAMBER
12 OLDHAM RING
13 LUBRICANT
14 LOWER BEARING
15*a* AREA OF FLANGE SECTION
15*b* AREA OF PROTRUDING REGION CONTINUING TO END OF INVOLUTE CURVE
16*a*, 16*b* CONNECTING SECTION
17 LOAD INCREASE
19 LUBRICATION HOLE
20 SUCTION SECTION
21 DISCHARGE SECTION
Lci PERFECT CIRCLE
Liv INSIDE INVOLUTE CURVE
O CENTER OF SCROLL
P1 FIRST INTERSECTION
Pa, Pb INTERSECTION
R0 PROTRUDING REGION (EXCLUDED REGION)
R1 PROTRUDING REGION (FLANGE SECTION REGION)
t RADIUS

The invention claimed is:

1. A scroll compressor comprising:

a fixed scroll including an end plate and a spiral wrap standing on the end plate:

an orbiting scroll including an end plate and a spiral wrap standing on the end plate and having a compression chamber formed between the fixed scroll and the orbiting scroll, the compression chamber having a refrigerant to be compressed therein;

a suction section configured to introduce the refrigerant from an outside to an inside of the compressor;

a discharge section configured to discharge the refrigerant from the inside to the outside of the compressor; and an electric motor configured to orbit the orbiting scroll, wherein at least one scroll of the fixed scroll and the orbiting scroll includes a sliding surface which is formed outside a wrap with a depression section depressed with respect to the sliding surface and a flange section elevated with respect to the depression section, and wherein the flange section is a remaining region in a protruding region disposed outside a referential perfect circle, the remaining region being other than a region continuing to an end of an involute curve of a scroll formed with the flange section, the referential perfect circle having a radius set to a distance between the center of the scroll formed with the flange section and the end of the involute curve.

2. The scroll compressor according to claim 1, wherein the flange section is smaller in area than the region continuing to the end of the involute curve in the protruding section.

3. The scroll compressor according to claim 1, wherein the depression section includes a portion which is not machined.

4. The scroll compressor according to claim 1, wherein the scroll formed with the flange section has a lubrication hole for supplying lubricant inside the flange section or around the flange section.

5. The scroll compressor according to claim 4, wherein the lubrication hole is located downstream of an intersection position where the referential perfect circle and the flange section intersect first.

6. The scroll compressor according to claim 1, wherein the sliding surface is provided with flange sections.

7. The scroll compressor according to claim 1, wherein the flange section has a width of 20 mm or less.

* * * * *